US010806260B2

(12) United States Patent
Sugano et al.

(10) Patent No.: US 10,806,260 B2
(45) Date of Patent: Oct. 20, 2020

(54) CHAIR

(71) Applicant: KOKUYO CO., LTD., Osaka-shi, Osaka (JP)

(72) Inventors: Takao Sugano, Osaka (JP); Katsuaki Hayashi, Osaka (JP)

(73) Assignee: KOKUYO CO., LTD., Osaka-shi (JP)

( * ) Notice: Subject to any disclaimer, the term of this patent is extended or adjusted under 35 U.S.C. 154(b) by 0 days.

(21) Appl. No.: 16/464,451

(22) PCT Filed: Dec. 20, 2016

(86) PCT No.: PCT/JP2016/088002
§ 371 (c)(1),
(2) Date: May 28, 2019

(87) PCT Pub. No.: WO2018/116385
PCT Pub. Date: Jun. 28, 2018

(65) Prior Publication Data

US 2019/0343286 A1 Nov. 14, 2019

(51) Int. Cl.
*A47C 3/027* (2006.01)
*A47C 1/032* (2006.01)
*A47C 3/026* (2006.01)

(52) U.S. Cl.
CPC ..... *A47C 3/027* (2013.01); *A47C 1/03294* (2013.01); *A47C 3/026* (2013.01)

(58) Field of Classification Search
CPC .... A47C 3/027; A47C 3/0257; A47C 1/03294
See application file for complete search history.

(56) References Cited

U.S. PATENT DOCUMENTS 465,719 A 12/1891 Mitchell
4,183,492 A * 1/1980 Meiller ..... B60N 2/02 248/395

(Continued)

FOREIGN PATENT DOCUMENTS

AT 507534 A2 * 5/2010 ..... A47C 1/03294
CA 2368211 A1 * 8/2001 ..... A47C 1/03294

(Continued)

OTHER PUBLICATIONS

International Search Report dated Apr. 4, 2017, issued in counterpart application No. PCT/JP2016/088002 (2 pages).

(Continued)

*Primary Examiner* — Timothy J Brindley
(74) *Attorney, Agent, or Firm* — Westerman, Hattori, Daniels & Adrian, LLP

(57) ABSTRACT

A chair includes: a leg 1; a seat 2; and a front-back support mechanism 4. The front-back support mechanism 4 is provided at a seat receiving part 50 directly supported by the leg 1, and the front-back support mechanism includes: a wavy plate 56 provided to horizontally extend from vertical walls 51 of the seat receiving part 50 and having mound-shaped surfaces 57, 58 each convexly curved upward; and followers 53, 54 provided at front-back support bodies 52 as supported parts and configured to move relative to the mound-shaped surfaces 57, 58 while contacting the mound-shaped surfaces 57, 58. The wavy plate 56 is associated with the followers 53, 54 such that a movement end inclines downward when the seat 2 moves from a neutral position in accordance with a relative movement between the mound-shaped surfaces 57, 58 and the followers 53, 54.

12 Claims, 12 Drawing Sheets

(56) References Cited

U.S. PATENT DOCUMENTS

| | | | | | |
|---|---|---|---|---|---|
| 5,048,893 | A * | 9/1991 | Cowan | A47C 9/002 297/313 |
| 8,613,482 | B2 * | 12/2013 | Ni | A47C 1/026 297/302.3 |
| 9,033,415 | B2 * | 5/2015 | Hopke | A47D 9/02 297/260.2 |
| 2005/0051401 | A1 | 3/2005 | Shimazaki et al. | |
| 2014/0103689 | A1 * | 4/2014 | Birkbeck | A47C 1/03277 297/300.1 |
| 2019/0045928 | A1 * | 2/2019 | Yajima | A47C 3/0255 |

FOREIGN PATENT DOCUMENTS

| | | | | |
|---|---|---|---|---|
| DE | 4239548 | A1 * | 4/1993 | A47C 3/0257 |
| JP | 10000128 | A * | 1/1998 | A47C 3/0257 |
| JP | 2000-120776 | A | 4/2000 | |
| JP | 2004-8440 | A | 1/2004 | |
| JP | 2005-83499 | A | 3/2005 | |
| JP | 2009-293693 | A | 12/2009 | |
| JP | 2014-4324 | A | 1/2014 | |
| WO | 2007/010618 | A1 | 1/2007 | |
| WO | WO-2007010618 | A1 * | 1/2007 | A63G 13/06 |
| WO | WO-2009048448 | A1 * | 4/2009 | A47C 1/023 |
| WO | WO-2015167205 | A1 * | 11/2015 | A47C 1/03294 |

OTHER PUBLICATIONS

Office Action dated Apr. 7, 2020, issued in counterpart JP Application No. 2018-557276, with English Translation. (5 pages).

Extended (Supplementary) European Search Report dated Jul. 27, 2020, issued in counterpart EP Application No. 16924269.0 (4 pages).

* cited by examiner

CHAIR

TECHNICAL FIELD

The present invention relates to a chair suitably applicable in an office or the like.

BACKGROUND ART

Many chairs such as chairs intended for a sitting person to maintain a comfortable sitting posture for a long time in an office, at home, or the like have been conventionally provided (for example, see Patent Documents 1 and 2).

Each of the chairs is configured to tilt a seat or a backrest in accordance with mainly backward or forward tilting of a sitting person such that the sitting person can comfortably move while doing work. Also, the chair is configured to fix the seat and the backrest in position such that a desired sitting posture of the sitting person can be realized.

However, a sitting person sitting on a chair for a long time may usually seem to be apparently resting in his/her own comfortable posture. It has become clear that in practice, the sitting person consistently moves the lower back and the buttocks, and in addition, the thighs from a required posture and thereby keeps his/her comfortable posture on the chair.

Specifically, many sitting people may seem to be apparently resting in their own comfortable postures; however, it has been revealed that in practice, in a state where each of the sitting people is in a substantially comfortable posture, he/she is shifting positions of the lower back and the buttocks from the planar-view center horizontally in any directions, i.e., in front-back and right-left directions, and in the meantime, maintains his/her comfortable posture on the chair. In addition, it has been revealed that when the sitting person can smoothly perform such a movement, he/she further improves efficiency of his/her work without feeling uncomfortable while working in the chair.

Therefore, it will be understood that a current chair is required to have a function that can appropriately support the foregoing sitting person's behavior.

CITATION LIST

Patent Literature

Patent Document 1: U.S. Pat. No. 465,719

Patent Document 2: Japanese Unexamined Patent Application Publication No. 2014-004324

SUMMARY OF THE INVENTION

Problem to be Solved by the Invention

Here, in order to guide movement of a sitting person to a required posture, each of the chairs described in Patent Documents 1 and 2 includes cam surfaces provided in one of a leg and a seat, and cam followers including rolling members such as rollers provided at the other of the leg and the seat, therefore being configured to allow the sitting person to easily move the seat forward or rearward.

However, the chair described in each of Patent Documents 1 and 2 is configured such that each of the cam surfaces is established on an end surface of a vertical wall, therefore currently having a problem with strength or durability.

The present invention is intended to solve the above problem, and an object of the present invention is to provide a chair that is simply configured while keeping high durability, that can almost optimally support a sitting person to match movement of the sitting person and therefore enables the sitting person to have good sitting comfort even when the sitting person is seated for a long time, and in addition that allows the sitting person to stably maintain high efficiency of his/her work.

Means for Solving the Problem

The present invention adopts the following means in order to achieve such an object.

In other words, a chair according to the present invention includes: a leg provided to stand from a floor surface; a seat provided above the leg; and a support mechanism interposed between the leg and the seat. The support mechanism including a wavy plate provided at one of a supported part directly or indirectly supported by the leg and a support part directly or indirectly supporting the seat, provided to horizontally extend from a vertical wall of the support part or the supported part and having a mound-shaped surface convexly curved upward or downward; and a follower provided at the other of the support part and the supported part and configured to allow a relative movement to the mound-shaped surface while contacting the mound-shaped surface. The wavy plate is associated with the follower such that a movement end inclines downward when the seat moves from a neutral position in accordance with a relative movement between the mound-shaped surface and the follower.

With such a configuration, the wavy plate is provided to horizontally extend from the vertical wall and to serve as a pressure receiving surface. Thus, a wide pressure receiving area is secured compared with a case where a cam surface is simply established on an end surface of a vertical wall. Consequently, the stability and smoothness of movement can be improved. In addition, the wavy plate is very appropriate to allow the movement end to incline downward in accordance with the movement. Further, with such the configuration as described, assembling easiness can be obtained.

In addition to the support mechanism, in order to allow the seat stably and smoothly in accordance with the relative movement between the mound-shaped surface and the follower, it is desirable that the chair may include a second support mechanism is configured to allow the seat to move in a direction intersecting with a relative movement direction between the mound-shaped surface and the follower. With such a configuration, the structure to move the seat by the second support mechanism in the direction intersecting with the relative movement direction can be effectively applied without deterioration of the stability, and it is possible to realize a variety of movements of the seat.

In order that the mound-shaped surface is formed in a simple shape and that at least one or both of the right-left followers can appropriately relatively move to the mound-shaped surface, it is desirable that the mound-shaped surface is provided to extend in a direction intersecting with a relative movement direction to the follower so as to straddle a center line in one of a front-back direction and a left-right direction of the seat, and that the followers are arranged so as to make contact with the mound-shaped surface at opposite side of the center line.

As a configuration for securing the pressure receiving area of the mound-shaped surface and the follower sufficiently and improving the strength of the wavy plate, it is desirable that the mound-shaped surface is provided to extend in a direction intersecting with a relative movement direction to the follower so as to straddle a center line in one of a front-back direction and a right-left direction of the seat, and that the follower extends from one end to the other end in a direction orthogonal to a guide direction of the mound-shaped surface and has a shape to be contactable with the mound-shaped surface from the one end to the other end.

In order to allow the seat to move stably and smoothly in accordance with the relative movement between the mound-shaped surface and the follower, it is desirable that the seat is supported independently movably in each of the front-back direction and the right-left direction, and that the support mechanism supporting the movement in at least one of the front-back direction and the right-left direction is configured to include the wavy plate and the follower. With such a configuration, the support mechanism is very suitable as one of movement guides in particular at the time of movement of the seat independently in each of two directions orthogonal to each other.

As a configuration for offering better sitting comfort to a seat, the support mechanism may be configured to shift the center of gravity of the seat upward in accordance with the movement of the seat from the neutral position when no one is seated. With such a configuration, the center height of the seat is shifted upward while a portion thereof located at the side toward which the seat swings is inclining downward. Therefore, the chair provided with the sitting comfort that is not offered by a conventional chair can be realized. In addition, the return force in a retuning direction increases as the seat moves; therefore, a mechanism to allow the seat to return to the neutral position can be appropriately realized without the application of a complicated structure.

In order to secure the stable movement by the wavy plate and stably mount the wavy plate to another member, it is desirable that the chair includes an anti-removal element configured to make contact with the back side of a contact surface with which the follower makes contact with respect to the mound-shaped surface on the wavy plate and to prevent separation between the mound-shaped surface and the follower. In other words, basically in the present invention, the follower is only overlapped with the mound-shaped surface in an up-down direction. Accordingly, in such a condition, the mound-shaped surface and the follower are not restrained with each other. Therefore, when the chair is lifted upward, the mound-shaped surface and the follower may be separated. However, with the above configuration, the mound-shaped surface and the follower can be surely integrally configured so as not to separate.

In order to smoothly attain anti-removal of the wavy plate with respect to another member and prevent looseness, it is desirable that the anti-removal element is an anti-removal follower contactable with the back side of the contact surface.

Additionally, in a case where the wavy plate is curved in a mound-shape, there is a turning radius difference exists between an inner circumference and an outer circumference. Therefore, when an anti-removal link is fixed, the anti-removal follower is likely to be engaged with the mound-shaped surface, and conversely, is likely to be disengaged from the mound-shaped surface. Accordingly, in a case where the anti-removal element is swingably supported thorough the link by the follower, the follower can be consistently maintained in a contact state with the mound-shaped surface while the link is swinging in an appropriate manner.

Effect of the Invention

The present invention is configured as described above and therefore can provide the chair that is simply configured, that can stably exert a function allowing the sitting person to have good sitting comfort even when the sitting person is seated for a long time, and in addition that allows the sitting person to stably maintain high efficiency of his/her work.

MODE FOR CARRYING OUT THE INVENTION

Herein, embodiments of the present invention will be described with reference to the drawings.

First Embodiment

A chair according to a first embodiment of the present invention is referred to as an office swivel chair suitably applicable in an office or at home.

Figure 1:
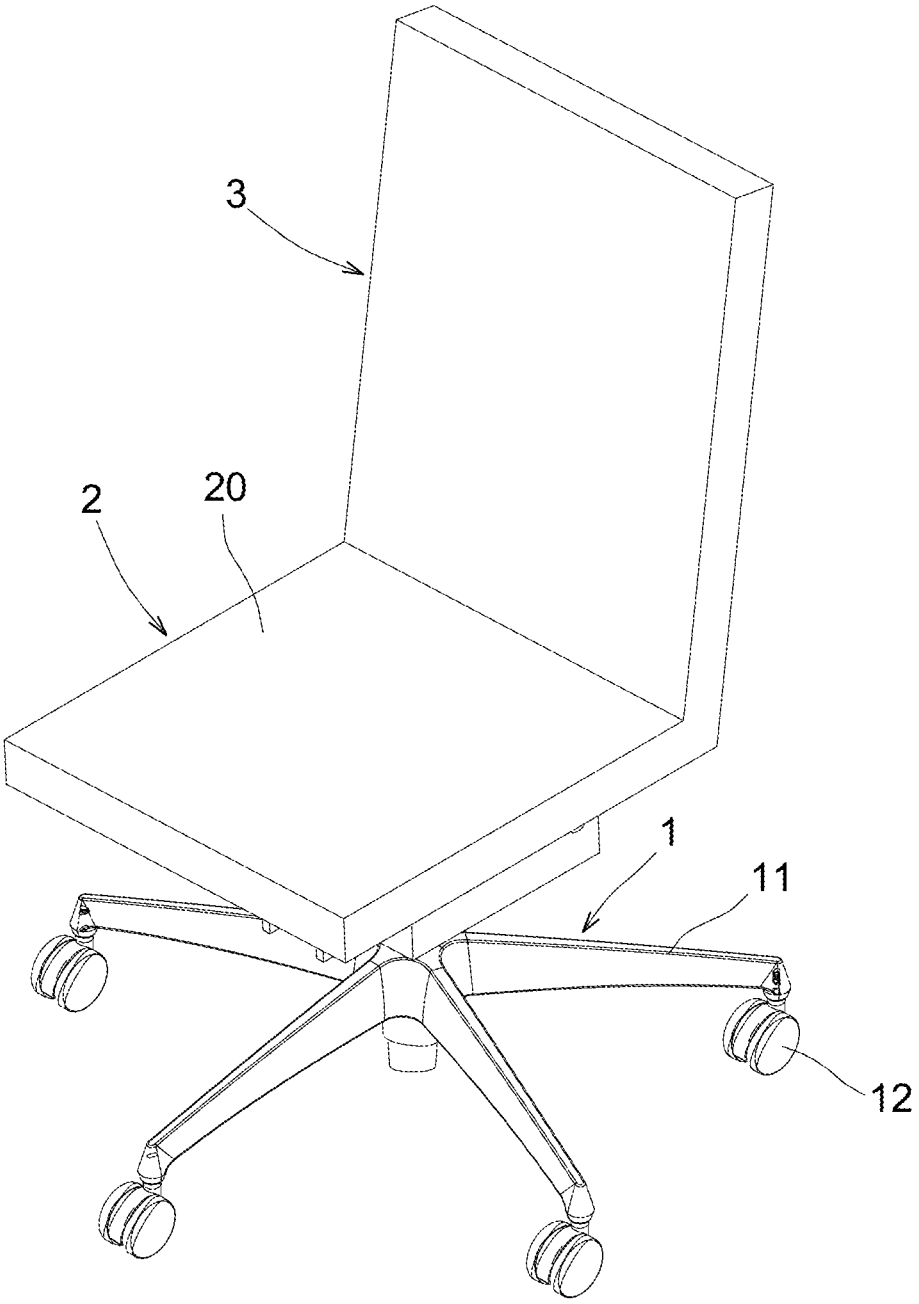
FIG. 1 is a perspective view of a chair according a first embodiment of the present invention.
Figure 2:
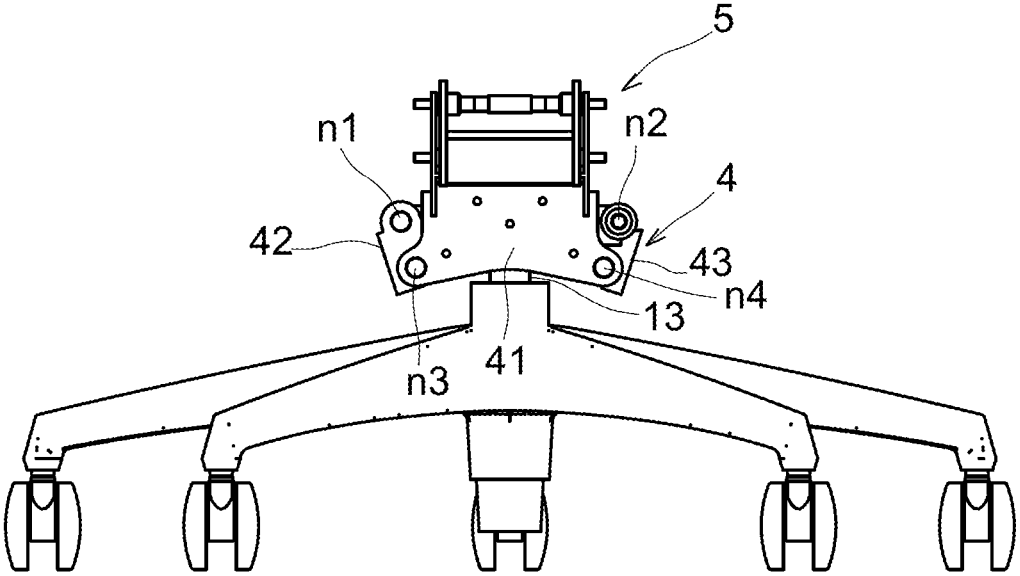
FIG. 2 is a front view of the chair from which some components of FIG. 1 are removed.
Figure 3:
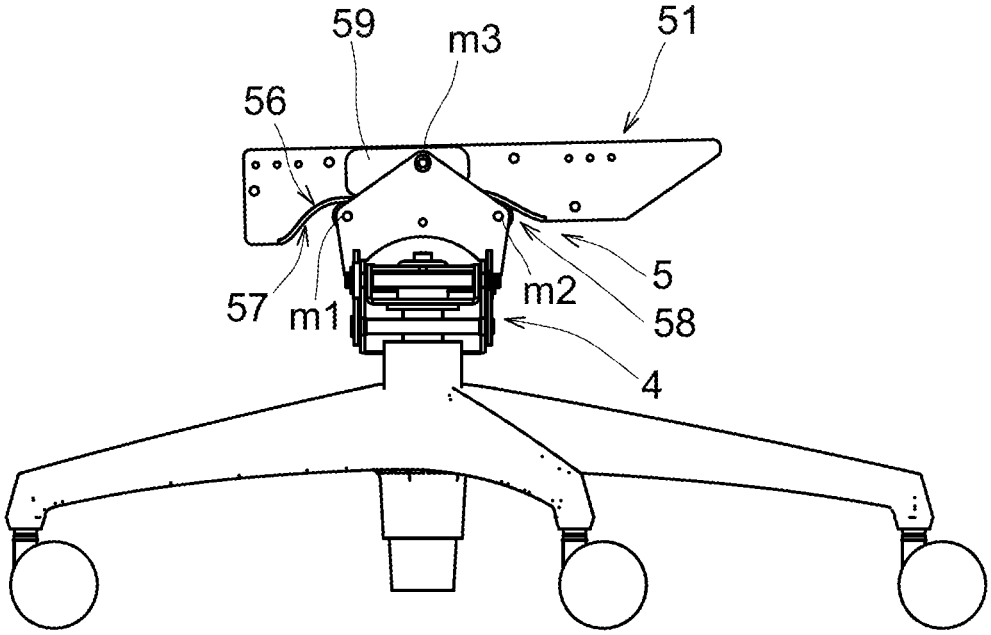
FIG. 3 is a right-side view of the chair from which some components of FIG. 1 are removed.
Figure 4:
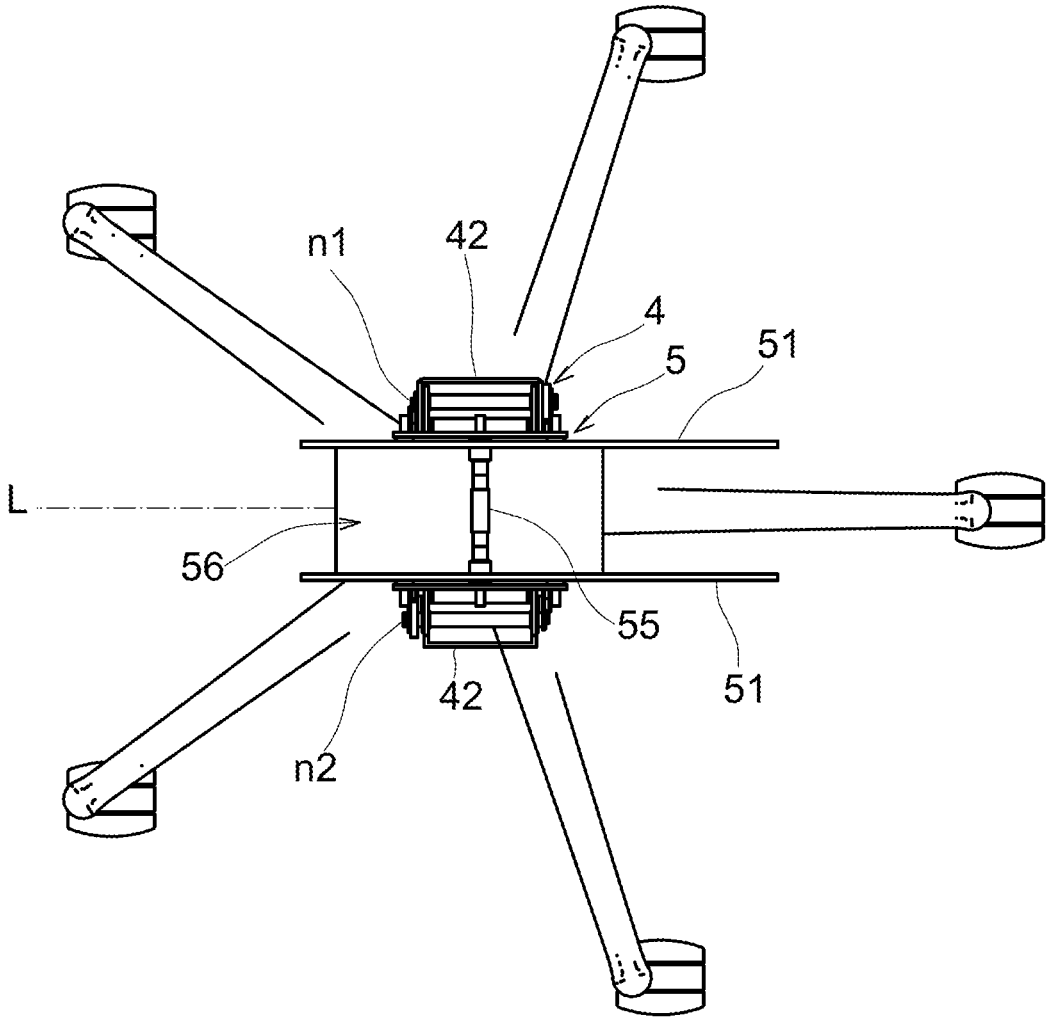
FIG. 4 is a plan view of the chair from which some components of FIG. 1 are removed.
Figure 5:
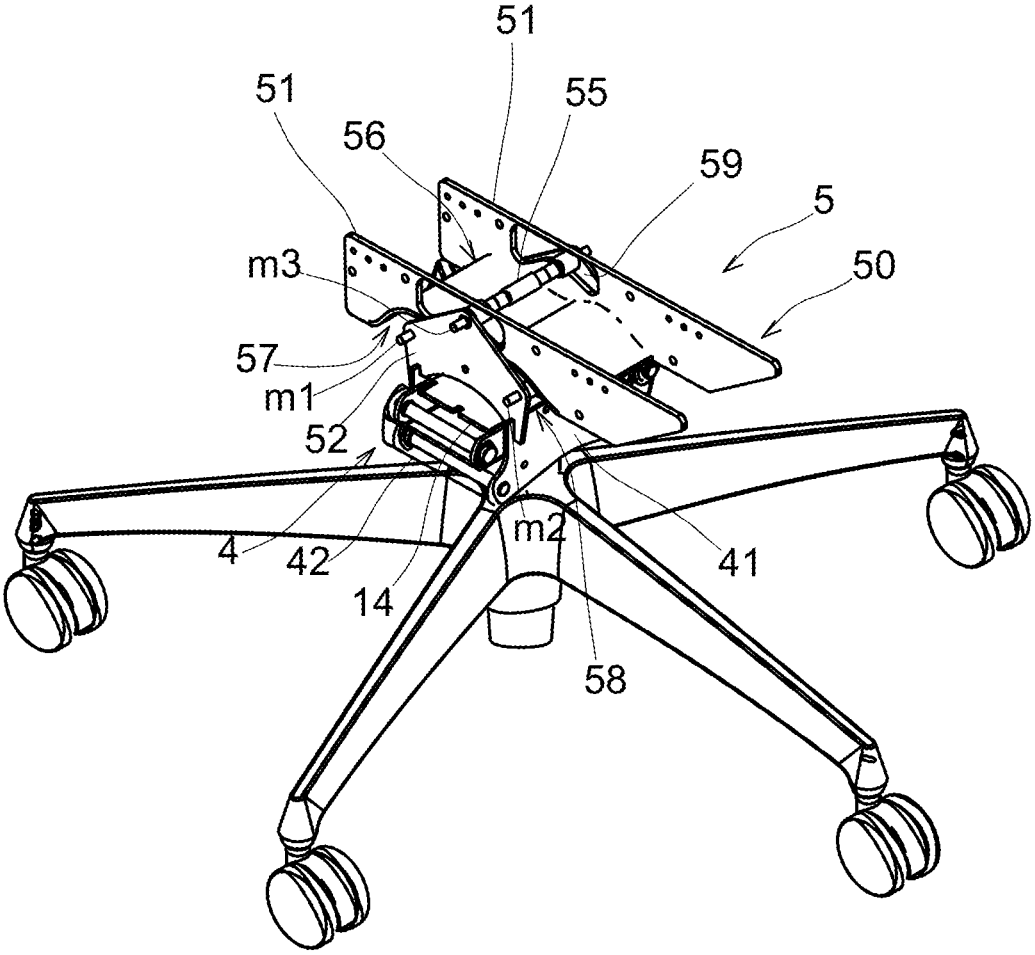
FIG. 5 is a perspective view of the chair from which some components of FIG. 1 are removed.
Figure 6:
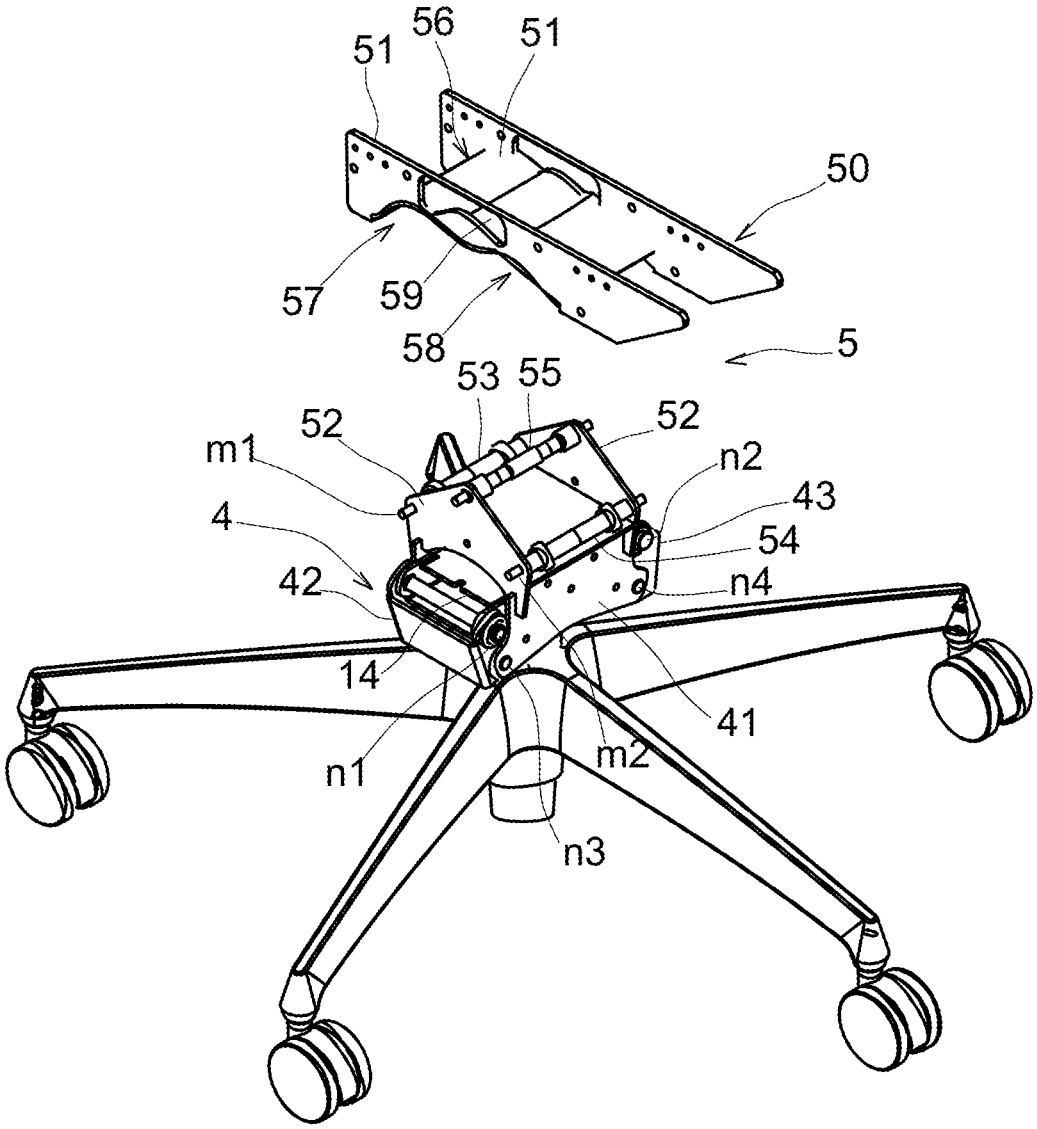
FIG. 6 is an exploded perspective view of FIG. 5.
Figure 7:
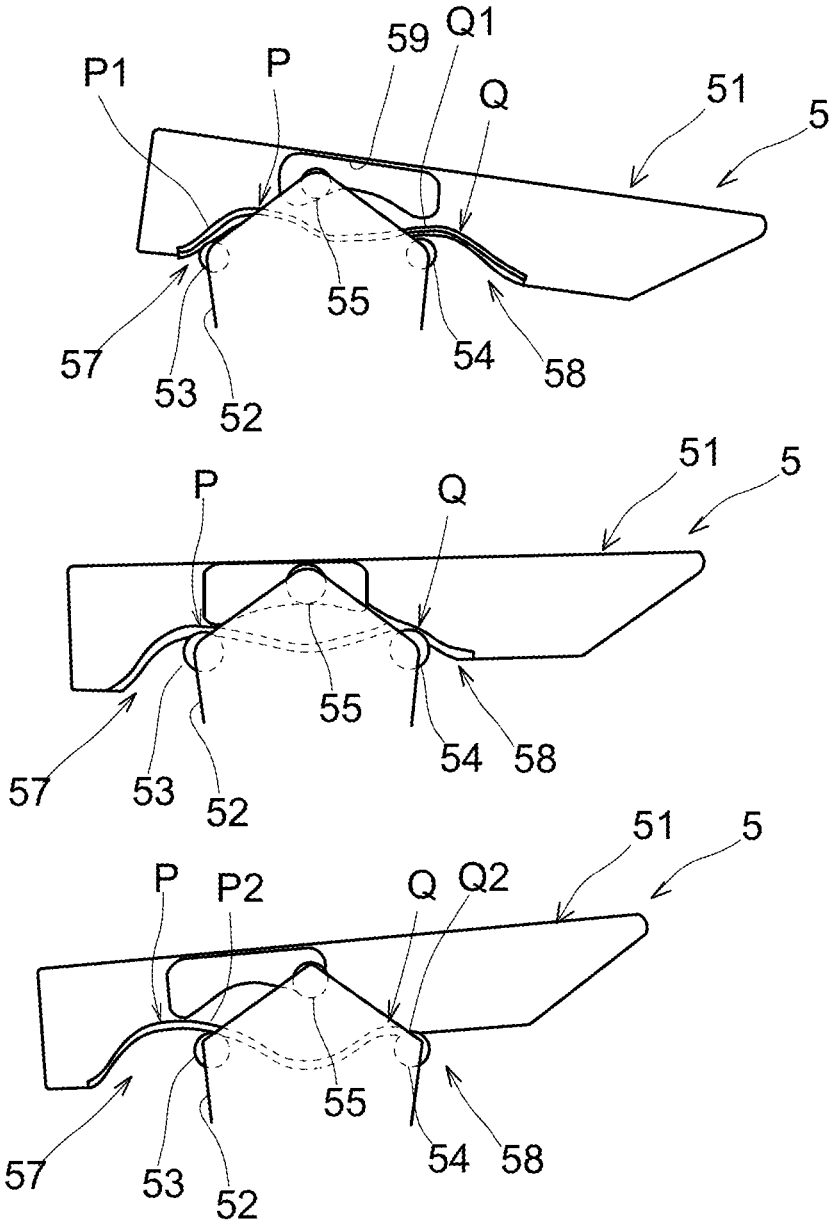
FIG. 7 is an explanatory diagram of operation according to the first embodiment of the present invention.
Figure 8:
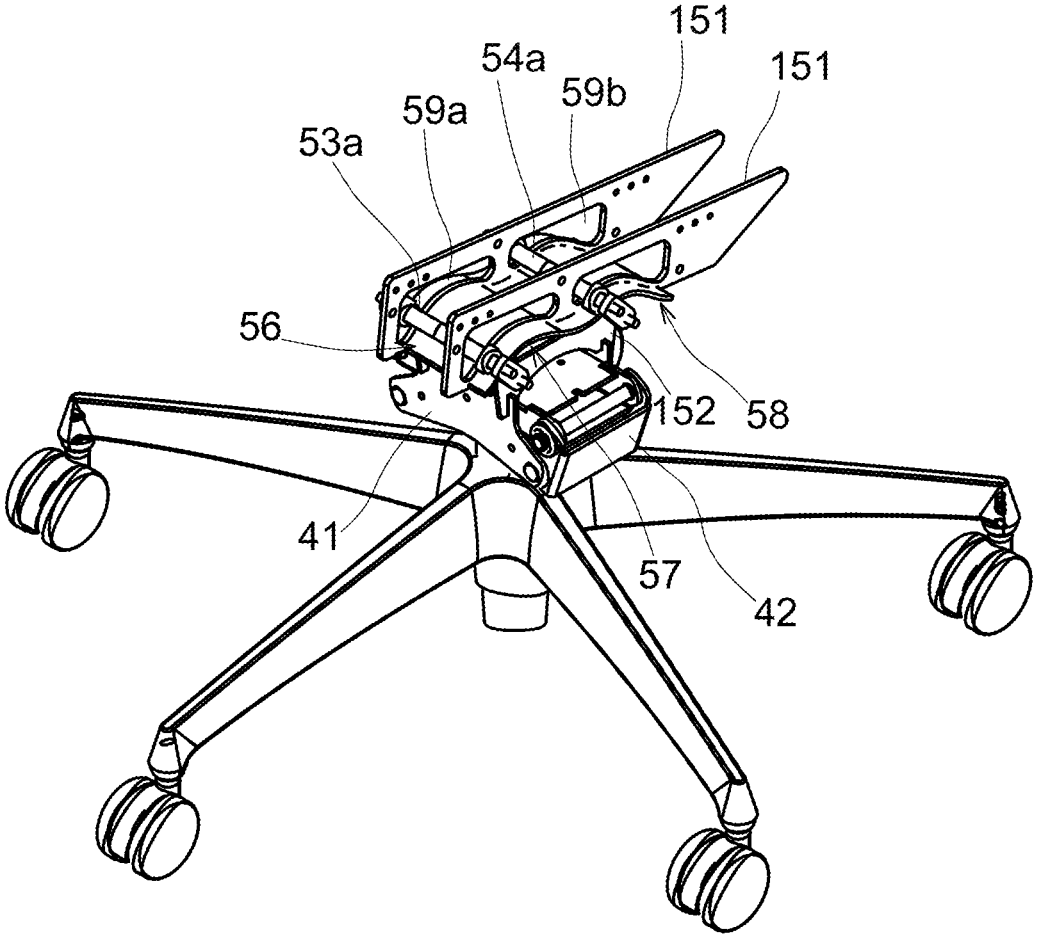
FIG. 8 is a perspective view of the chair according to a second embodiment of the present invention and corresponding to FIG. 5.
Figure 9:
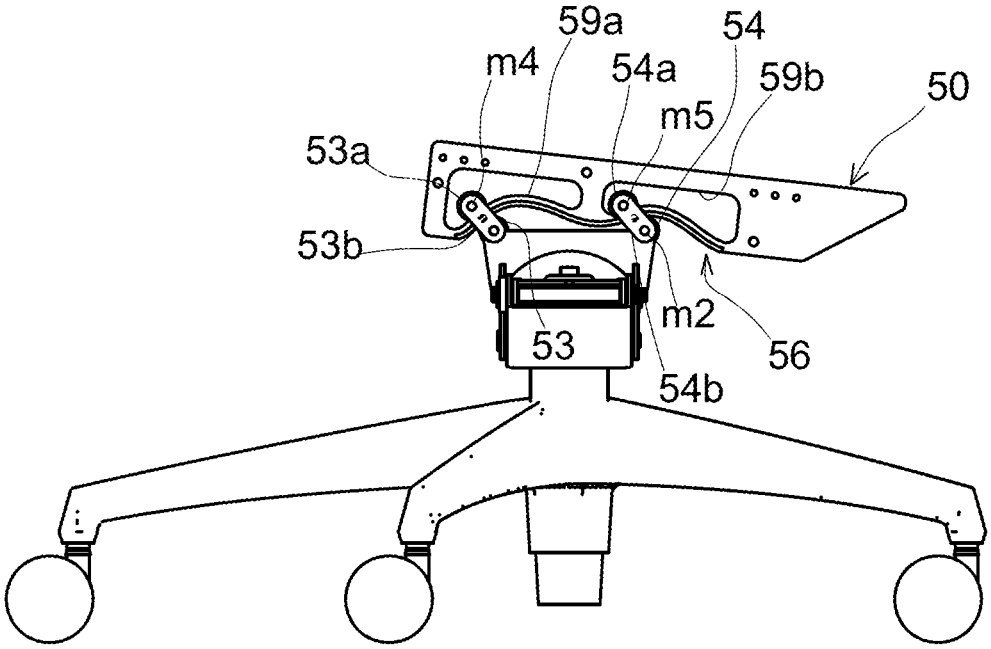
FIG. 9 is a right-side view corresponding to FIG. 3.

FIG. 1 is a perspective view of the chair according to the first embodiment. FIG. 2 is a front view of the chair from which some components of FIG. 1 are removed. FIG. 3 is a right-side view of the chair from which some components of FIG. 1 are removed. FIG. 4 is a plan view of the chair from which some components of FIG. 1 are removed. FIG. 5 is a perspective view of the chair from which some components of FIG. 1 are removed. FIG. 6 is an exploded perspective view of FIG. 5. FIG. 7 is an explanatory diagram of operation. For the sake of explanation, some of components such as links are not illustrated in FIGS. 2 to 5.

The chair includes a leg 1 provided to stand from a floor surface, a seat 2 disposed above the leg 1 and integrally provided with a backrest 3, and a right-left support mechanism 4 and a front-back support mechanism 5 that are interposed between the leg 1 and the seat 2. The support mechanisms 4, 5 function to guide the seat 2 such that a movement end inclines downward at the time of front-back or right-left movement of the seat 2 from a neutral position thereof when no one is seated.

The leg 1 includes a leg blade 11 radially formed in planar view and casters 12 attached on the lower side of the leg blade 11 to rotatably make contact with the floor surface. A leg pole 13 is provided to stand from the center of the leg blade 11, and the seat 2 is rotatably supported by the leg pole 13.

In the first embodiment, the seat 2 mainly includes a seat body 20 integrally formed with the backrest 3. An upper surface of the seat body 20 serves as a seating surface, and a seat receiving part 50 to be supported from below is disposed on a lower surface of the seat body 20.

The right-left support mechanism 4 is disposed between right-left support bodies 41 each supported by the leg 1 to serve as a movement side support part, and a support base 14 serving as a fixation side supported part relative to the right-left support bodies 41. The right-left support mechanism 4 is configured to connect the right-left support bodies 41 as the support parts to the support base 14 as the supported part.

Further, the front-back support mechanism 5 is disposed between the seat receiving part 50 indirectly supported by the leg 1 to serve as a movement side support part, and front-back support bodies 52 each serving as a fixation side supported part relative to the seat receiving part 50 so as to support the seat 2. The front-back support mechanism 5 includes a wavy plate 56 and followers 53, 54 formed of rotatable rollers. The wavy plate 56 is provided at one of the support part and the supported parts, i.e., at the seat receiving part 50 as the movement side support part in the first embodiment. The followers 53, 54 are arranged via shafts m1, m2 at the other of the support part and the supported parts, i.e., at the front-back support bodies 52 as the supported parts that are not relatively movable.

Specifically, the right-left support mechanism 4 is configured such that lower end shafts n3, n4 are hung via a pair of link members 42, 43 from upper end shafts n1, n2 set on the support base 14. Each of the bracket-shaped right-left support bodies 41 is attached between the lower end shafts n3, n4 of the right and left link members 42, 43. In this case, a distance between the lower end shafts n3, n4 is set to be smaller than a distance between the upper end shafts n1, n2. The right-left support bodies 41 are disposed at the lowest position by gravity, that is, the right-left support bodies 41 are at a neutral position. When the right-left support bodies 41 swing from the neutral position in a right-left direction, the link members 42, 43 follow the right-left swinging while pivoting. Then, as being dislocated from the neutral position, the right-left support bodies 41 move such that the position of center of gravity thereof shifts upward, and in addition, the return force to the neutral position increases in accordance with the amount of movement. Moreover, in accordance with the right-left movement from the neutral position, one link member 42 (43) of the link members 42, 43 located at a movement destination comes close to a vertical posture and the lower end shaft n3 (n4) moves downward. Meanwhile, the other link member 43 (42) of the link members 42, 43 comes close to a horizontal posture and the lower end shaft n4 (n3) moves upward. As a result, the right-left support bodies 41 supported by the link members move such that a movement end inclines downward.

Meanwhile, the front-back support mechanism 5 includes a pair of the front-back support bodies 52, 52 provided above a pair of the right-left support bodies 41, 41 to connect the right-left support bodies 41, 41. The first follower 53 and the second follower 54 that are located forward and rearward are arranged between the front-back support bodies 52, 52. An anti-removal follower 55 formed of a rotatable roller is pivotally attached via a shaft m3 to a portion dislocated upward from an intermediate position between the followers 52, 53. With respect to the configuration, a pair of vertical walls 51, 51 are rigidly connected therebetween by the wavy plate 56, therefore configuring the seat receiving part 50. First and second mound-shaped surfaces 57, 58 are formed on the wavy plate 56 by an appropriate technical method such as press forming of a steel plate with rigidity, die-cast molding with aluminum or shaving of aluminum or the like, or injection molding with synthetic resin.

That is, the mound-shaped surfaces 57, 58 are formed to have a curved shape protruded upward. The positional relation of the mound-shaped surfaces is set such that the first mound-shaped surface 57 is disposed to be contactable with the first follower 53 and that the second mound-shaped surface 58 is disposed to be contactable with the second follower 54. More specifically, the mound-shaped surfaces 57, 58 are provided from one side to the other side in a width direction to extend in a direction intersecting with a relative movement direction with respect to the followers 53, 54 and to stride across a center line L (see FIG. 4) in the right-left direction of the seat 2. The followers 53 are arranged at the opposite sides of the center line L to make contact with the mound-shaped surface 57, and the followers 54 are arranged at the opposite sides of the center line L to make contact with the mound-shaped surface 58.

In this case, the seat receiving part 50 is at the lowest position by gravity when no one is seated, which is defined as a neutral position. In a state where the seat receiving part 50 is at the neutral position, portions respectively in contact with the first follower 53 and the second follower 54 are defined as a reference position P of the first mound-shaped surface 57 and a reference position Q of the second mound-shaped surface 58 (see FIG. 7B). When the seat receiving part 50 moves rearward from the reference positions P, Q in accordance with the movement of the seat 2 as illustrated in FIG. 7A, a region P1 of the first mound-shaped surface 57, which is located forward of the reference position P is brought into contact with the follower 53 and a region Q1 of the second mound-shaped surface 58, which is located forward of the reference position Q is brought into contact with the follower 54. At this time, the seat receiving part 50 tilts rearward, and the geometries of the mound-shaped surfaces 57, 58, the shape and attachment position of the seat 2, and the like are set so that the center of gravity of the whole seat is shifted upward when the seat receiving part 50 tilts rearward. Therefore, when an external force is removed, the seat 2 moves by a return force due to gravity to the position in which the reference positions P, Q of the mound-shaped surfaces 57, 58 are brought into contact with the followers 53, 54. Consequently, the seat receiving part 50 returns to the neutral position. During returning of the seat receiving part 50 to the neutral position, the geometries of the mound-shaped surfaces 57, 58 allow the seat 2 to follow various preferable trajectory.

On the other hand, when the seat receiving part 50 moves forward from the reference position P, Q as illustrated in FIG. 7C in accordance with the movement of the seat 2, a region P2 of the first mound-shaped surface 57, which is located rearward of the reference position P is brought into contact with the follower 53 and a region Q2 of the second mound-shaped surface 58, which is located rearward of the reference position Q is brought into contact with the follower 54. At this time, the seat receiving part 50 tilts forward, and the geometries of the mound-shaped surfaces 57, 58, the shape and attachment position of the seat 2, and the like are set so that the center of gravity of the whole seat is shifted upward when the seat receiving part 50 tilts forward. Therefore, when an external force is removed, the seat 2 moves by a return force due to gravity to the position in which the reference positions P, Q of the mound-shaped surfaces 57, 58 are brought into contact with the followers 53, 54. Consequently, the seat receiving part 50 returns to the neutral position. During returning of the seat receiving part 50 to the neutral position, the geometries of the mound-shaped surfaces 57, 58 allow the seat 2 to follow various preferable trajectory.

Additionally, insertion holes 59 allowing insertion of the anti-removal follower 55 are provided along trajectory in which the anti-removal follower 55 provided at the front-back support bodies 52 follows in accordance with the movement of the seat receiving part 50. FIG. 6 illustrates a state where the anti-removal follower 55 is attached in advance; however, in practice, the wavy plate 56 is mounted and thereafter the follower 55 is attached to the front-back support bodies 52.

As described above, the chair according to the first embodiment includes the leg 1 provided to stand from the floor surface, the seat 2 provided above the leg 1, and the front-back support mechanism 4 including a wavy plate provided the one support mechanism of the support mechanisms interposed between the leg 1 and the seat 2. The front-back support mechanism 4 provided adjacent to the seat receiving part 50 as the support part that is indirectly supported by the leg 1, and the front-back support mechanism includes: the wavy plate 56 provided to horizontally extend from the vertical walls 51 of the seat receiving part 50 and having the mound-shaped surfaces 57, 58 each convexly curved upward; and the followers 53, 54 provided at the front-back support bodies 52 as the supported parts and is configured to make contact with the mound-shaped surfaces 57, 58 while relative movement to the mound-shaped surfaces 57, 58. The wavy plate 56 is associated with the followers 53, 54 such that a movement tip side inclines downward when the seat 2 moves from the neutral position in accordance with the relative movement between the mound-shaped surfaces 57, 58 and the followers 53, 54.

With such a configuration, without an influence of the structure or shape of the vertical wall 51 of the seat receiving part 50, the wavy plate 56 can be formed. Therefore, the movement by the mound-shaped surfaces 57, 58 functioning as cam surfaces and by the followers 53, 54 can be realized without being restricted by the structure and shape of the vertical wall 51 configuring the chair. In addition, the structure that can offer truly good sitting comfort to a sitting person can be realized. Further, the wavy plate 56 is provided to horizontally extend from of the vertical walls 51 and to serve as a pressure receiving surface. Thus, a wide pressure receiving area is secured compared with a pressure receiving surface having a thickness provided when a cam surface is simply established on an end surface of each of the vertical walls 51. Consequently, the stability and smoothness of movement can be improved. Additionally, only the wave shape of the wavy plate 56 is changed and thereby various characteristics can be realized. Thus, the wavy plate 56 is very appropriate to allow a movement end to incline downward. Also, assembling easiness can be obtained.

In addition to the front-back support mechanism 5, the right-left support mechanism 4 as a second support mechanism is provided. The second support mechanism is configured to allow the seat 2 in a direction intersecting with the relative movement direction between the mound-shaped surfaces 57, 58 and the followers 53, 54.

As described above, the seat 2 is moved stably and smoothly in accordance with the relative movement between the mound-shaped surfaces 57, 58 and the followers 53, 54. Therefore, the structure to allow the seat 2 by the right-left support mechanism 4 in the direction intersecting with the relative movement direction can be effectively applied without deterioration of the stability, and the seat 2 can move in various ways.

Moreover, the mound-shaped surfaces 57, 58 are provided to extend in the direction intersecting with the relative movement direction with respect to the followers 53, 54 and so as to straddle across the center line L in the right-left direction of the seat 2. The followers 53 are arranged at the opposite sides of the center line L to make contact with the mound-shaped surface 57, and the followers 54 are arranged at the opposite sides of the center line L to make contact with the mound-shaped surface 58.

With such a configuration, each of the mound-shaped surfaces 57, 58 is formed in a simple shape, and at least one or both of the right and left followers 53 can appropriately relative movement to the mound-shaped surface 57 and at least one or both of the right and left followers 54 can appropriately relative movement to the mound-shaped surface 58.

Also, the mound-shaped surfaces 57, 58 are provided to extend in the direction intersecting with the relative movement direction with respect to the followers 53, 54 and so as to straddle across the center line L in the right-left direction of the seat 2. The followers 53, 54 are provided to extend from one end to the other end in a direction orthogonal to a guide direction of the mound-shaped surfaces 57, 58, and are shaped to be contactable with the mound-shaped surfaces 57, 58 from the one end to the other end. In addition, the number of followers is not limited. Two or more followers may be integrally provided to be coaxial to each other.

With such a configuration, a sufficient pressure receiving area between the mound-shaped surface 57, 58 and the followers 53, 54 can be secured, and the strength of the wavy plate can be increased.

Further, the seat 2 is supported independently movably in each of the front-back direction and the right-left direction, and the support mechanism to support the front-back movement is configured as the front-back support mechanism 5 including the wavy plate 56 and the followers 53, 54.

Thus, the seat 2 is moved stably and smoothly in accordance with the relative movement between the mound-shaped surfaces 57, 58 and the followers 53, 54. Consequently, the front-back support mechanism is very suitable as one of movement guides in particular at the time of movement of the seat part 2 independently in each of two directions orthogonal to each other.

Furthermore, the front-back support mechanism 5 is configured to shift the center of gravity of the seat 2 upward in accordance with the movement of the seat 2 from the neutral position when no one is seated.

With such a configuration, the center height of the seat 2 is shifted upward while a portion thereof located at the side toward which the seat 2 swings is inclining downward. Therefore, the chair provided with the sitting comfort that is not offered by a conventional chair can be realized. In addition, the return force in a retuning direction increases as the seat moves; therefore, a mechanism to allow the seat to return to the neutral position can be appropriately realized without the application of a complicated structure.

The anti-removal follower 55 is further provided as an anti-removal element configured to make contact with the insertion holes 59 from the back side of a contact surface with which the followers 53, 54 make contact with respect to the mound-shaped surfaces 57, 58 on the wavy plate 56 and to prevent separation between the followers 53, 54 and the mound-shaped surfaces 57, 58.

In other words, basically in the first embodiment, the followers 53, 54 are only overlapped with the mound-shaped surfaces 57, 58 in an up-down direction. Accordingly, in such a condition, the mound-shaped surfaces 57, 58 and the followers 53, 54 are not restrained with each other. Therefore, when the chair is lifted upward, the mound-shaped surfaces 57, 58 and the followers 53, 54 may be separated. Thus, the above configuration the mound-shaped surfaces and the followers can be surely integrally configured so as not to separate.

In particular, the anti-removal element is the anti-removal follower 55 contactable on the back side with respect to the insertion holes 59. Consequently, anti-detachment or anti-removal can be smoothly attained and also looseness can be prevented.

Second Embodiment

The chair illustrated in FIGS. 8 and 10A to 10C includes the wavy plate 56 and the followers 53, 54 that are basically the same as those of the first embodiment, but are formed in small size such that the front-back support bodies 52 are not provided with the anti-removal follower 55. Therefore, the insertion holes 59 allowing insertion of the anti-removal follower 55 of the first embodiment are also not provided.

However, in a second embodiment, anti-removal followers 53*a*, 54*a* as anti-removal elements are respectively arranged through links 53*b*, 54*b* on the opposite side of the wavy plate 56 from the followers 53, 54.

In the drawings, the same reference numbers are assigned to portions identical to those of the first embodiment.

Also, the anti-removal followers 53*a*, 54*a* are configured to make contact with the back side of a contact surface with which the followers 53, 54 make contact with respect to the mound-shaped surfaces 57, 58 on the wavy plate 56 and to prevent separation between the followers 53, 54 and the mound-shaped surfaces 57, 58. Portions indicated by reference numbers 59*a*, 59*b* in the drawings are relief holes by which interference with shafts m4, m5 is avoided, and the followers 53*a*, 54*a* are not in contact with the mound-shaped surfaces as in the first embodiment.

Figure 10A:
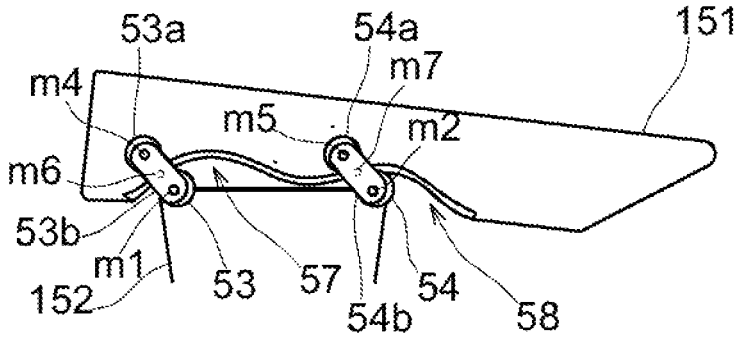
FIGS. 10A to 10C are explanatory diagrams of operation corresponding to FIG. 7.
Figure 10B:
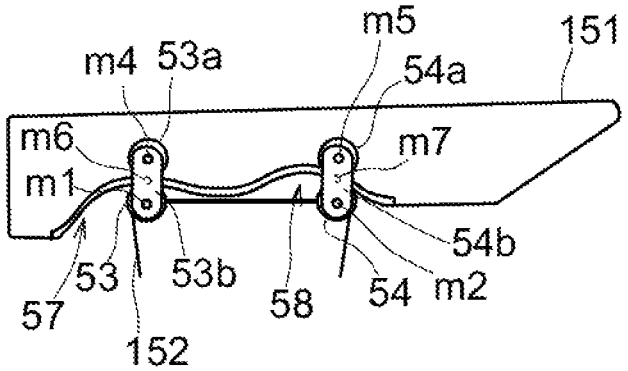
Figure 10C:
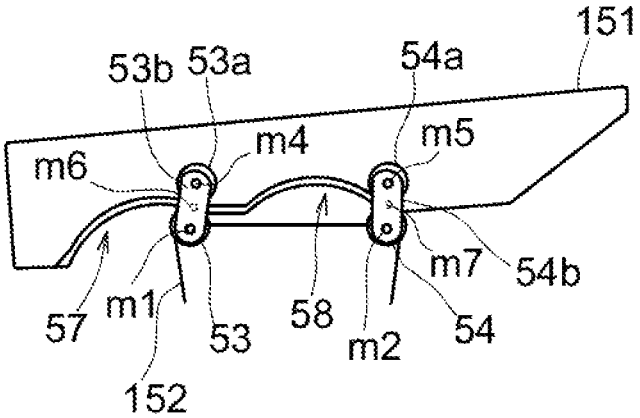

With such a configuration, as illustrated in FIGS. 10A to 10C, the mound-shaped surfaces 57, 58 are firstly brought into contact with the followers 53, 54. Therefore, the same guide function as in the first embodiment is exerted through the movement from a state of FIG. 10A after the seat 2 is moved rearward from the neutral position of FIG. 10B, to a state of FIG. 10C after the seat 2 is moved forward from the neutral position of FIG. 10B. The anti-removal followers 53*a*, 54*a* are respectively contactable via the links 53*b*, 54*b* with two positions of the back side of the wavy plate 56. Therefore, the wavy plate 56 can be more effectively prevented from being detached from the followers 53, 54, for example, when the chair is lifted upward.

As described, the anti-removal elements are the anti-removal followers 53*a*, 54*a* contactable with the back side of the wavy plate; therefore, anti-detachment or anti-removal can be smoothly attained and also looseness can be prevented.

In particular, in a case where the wavy plate 56 is curved in a mound-shape, the anti-removal followers fail to follow the movement of the wavy plate and therefore are likely to be engaged with the mound-shaped surfaces, and conversely, are likely to be disengaged from the mound-shaped surfaces. However, the anti-removal followers 53*a*, 54*a* are swingably supported via the links 53*b*, 54*b* by the followers 53, 54. Thus, the anti-removal followers 53*a*, 54*a* can be maintained in position in a contact state with the mound-shaped surfaces 57, 58 while the links 53*b*, 54 are pivotally swinging in an appropriate manner as illustrated in FIGS. 10A to 10C.

In addition, in examples illustrated in the drawings, the shafts m1, m2 are set as pivot points of the links 53*b*, 54*b*. Alternatively, the shafts m4, m5 may be set as pivot points of the links 53*b*, 54*b*.

Also, center points m6, m7 of the links 53*b*, 54*b* are supported by shafts and the center points m6, m7 may be configured to move along the center of the wavy plate 56. With such a configuration, a distance from the center point m6 to the follower 53 is equal to a distance from the center point m6 to the anti-removal follower 53*a*, and a distance from the center point m7 to the follower 54 is equal to a distance from the center point m7 to the anti-removal follower 54*a*. Thus, the followers 53 and the anti-removal followers 53*a* can move at the opposite sides of the wavy plate 56 in a similarly reasonable manner, and the followers 54 and the anti-removal followers 54*a* can move at the opposite sides of the wavy plate 56 in a similarly reasonable manner.

Also, various modifications can be made to the present invention other than the foregoing embodiments.

Figure 11B:
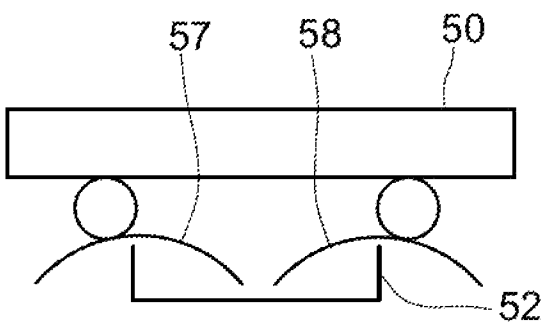
FIGS. 11A to 11D are drawings schematically illustrating a modified example of the present invention.
Figure 11D:
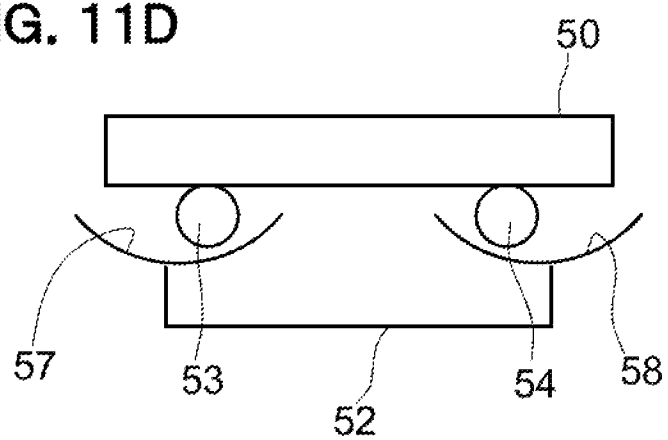
Figure 11A:
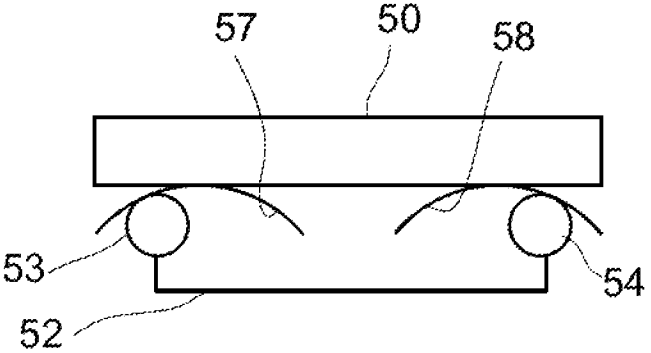

An example will be illustrated based on schematic views of FIGS. 11A to 11D. As illustrated in FIG. 11A, the front-back support mechanism 5 of the foregoing embodiments is disposed between the front-back support body 52 as the supported part supported by the leg 1 and the seat receiving part 50 as the support part configured to support the seat 2. The mound-shaped surfaces 57, 58 are provided on one of the support part and the supported part, i.e, on the seat receiving part 50, and meanwhile, the followers 53, 54 are provided on the other of the support part and the supported part, i.e., on the front-back support body 52. Alternatively, as illustrated in FIG. 11B, the mound-shaped surfaces 57, 58 may be provided on the other of the support part and the supported part, i.e, on the front-back support body 52, and meanwhile, the followers 53, 54 may be provided on one of the support part and the supported part, i.e., on the seat receiving part 50. In such cases, in FIG. 11A, the mound-shaped surfaces 57, 58 are respectively curved downward in a protruded shape, and the followers 53, 54 are provided on the lower side of the mound-shaped surfaces 57, 58 to be contactable with the lower side. Meanwhile, in FIG. 11B, the mound-shaped surfaces 57, 58 are respectively curved upward in a protruded shape, and the followers 53, 54 are provided on the upper side of the mound-shaped surfaces 57, 58 to be contactable with the upper side. In an example illustrated in FIG. 11D, adversely, the mound-shaped surfaces 57 in a downwardly protruded shape are provided on the support body 52, and the followers 53, 54 provided on the seat receiving part 50 are disposed on the upper side of the mound-shaped surfaces to make contact with the upper side.

Figure 11C:
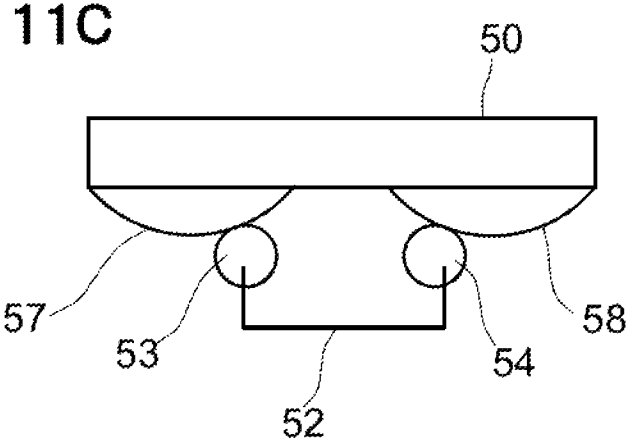

Also, as illustrated in FIGS. 11A, 11B, and 11D, the mound-shaped surfaces 57, 58 are configured such that when the seat receiving part is in the neutral position, the followers 53, 54 are brought into contact with regions of the mound-shaped surfaces 57, 58, which are respectively located forward and rearward of reference positions with respect to most-protruded inflection points. Alternatively, as illustrated in FIG. 11C, the neutral position may be set such that the first follower 53 is contactable with a rear region of the first mound-shaped surface 57 and that the second follower 54 is contactable with a front region of the mound-shaped surface 58.

In other words, at the time of forward movement of the seat from the neutral position, the mound-shaped surface 57 of the wavy plate 56 on the seat receiving part 50 tilts downward or the follower 53 shifts downward along the mound-shaped surface 57, and meanwhile, the mound-shaped surface 58 of the wavy plate 56 on the seat receiving part 50 tilts upward or the follower 54 shifts upward along the mound-shaped surface 58. If such a relation is satisfied and the center of gravity of the whole seat is shifted upward, the advantageous effect similar to that of the foregoing embodiments is exerted for the forward movement.

Also, at the time of rearward movement of the seat 2 from the neutral position, the mound-shaped surface 58 of the wavy plate 56 on the seat receiving part 50 tilts downward or the follower 54 shifts downward along the mound-shaped surface 58, and meanwhile, the mound-shaped surface 57 of the wavy plate 56 on the seat receiving part 50 tilts upward or the follower 53 shifts upward along the mound-shaped surface 58. If such a relation is satisfied and the center of gravity of the whole seat is shifted upward, the advantageous effect similar to that of the foregoing embodiments is exerted for the rearward movement.

Further, the wavy plate is provided to extend from one side to the other side of the pair of vertical walls in the foregoing embodiments. Alternatively, the wavy plate may be separated in the center.

Furthermore, at the time of making a hole in a vertical wall, a wavy plate integrally formed with the vertical wall can be formed by burring.

Moreover, in the foregoing embodiments, the guide by the wave-shaped follower is applied in the front-back support mechanism configured to guide the front to back movement and back to front movement of the seat. Alternatively, the wave-shaped follower may be applied to the right-left support mechanism configured to support the right to left movement and left to right movement of the seat or may be applied to both the front-back support mechanism and the right-left support mechanism.

Further, in the foregoing embodiments, the front-back support mechanism is supported by the right-left support mechanism. Alternatively, the right-left support mechanism may be supported by the front-back support mechanism.

Furthermore, the follower is not limited to a rotatable roller follower. Alternatively, a non-rotatable column slider or another configuration may be applied to the follower.

Figure 12:
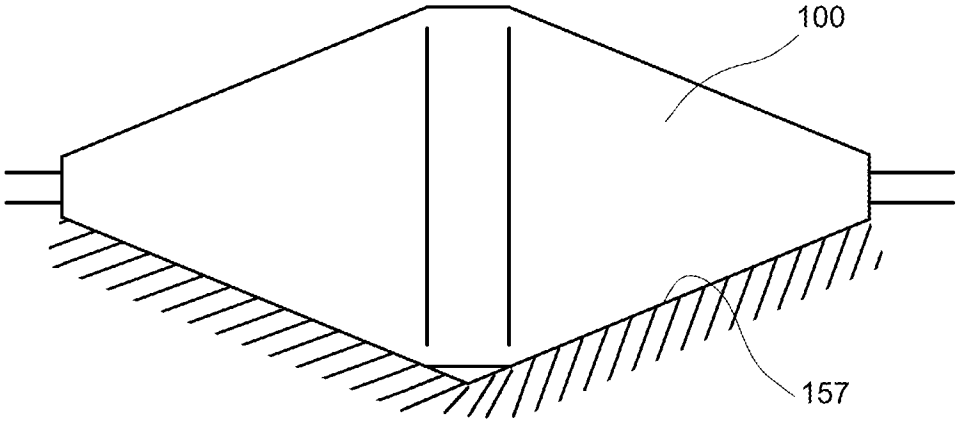
FIG. 12 is a drawing illustrating another modified example of the present invention.

In addition, as illustrated in FIG. 12, a follower 100 having a spindle-shape is applicable, and the cross-section of a mound-shaped surface 157 formed on the wavy plate may be configured to have a tapered shape along the follower 100. With such a configuration, offset force toward the center is applied in a direction orthogonal to a moving direction of the follower 100 with respect to the mound-shaped surface 157. Therefore, the follower 100 stably behaves and a pressure receiving area can be appropriately secured.

Moreover, the follower may be made of synthetic resin or a material, surface of which is of rubber with elasticity. With such a configuration, good sitting comfort can be further enhanced.

Various modifications can be also made to other configurations without departing from the scope of the present invention.

INDUSTRIAL APPLICABILITY

The present invention is applicable to a chair suitably used in an office or the like.

DESCRIPTION OF REFERENCE NUMERALS

1: leg
2: seat
4: front-back support mechanism
50: support part (seat receiving part)
51: vertical wall
57, 58: mound-shaped surface
56: wavy plate
53, 54: follower

The invention claimed is:

1. A chair comprising:

a leg provided to stand from a floor surface;

a seat provided above the leg; and a support mechanism interposed between the leg and the seat, wherein the support mechanism including a wavy plate provided at one of a supported part directly or indirectly supported by the leg and a support part directly or indirectly supporting the seat, provided to horizontally extend from a vertical wall of the support part or the supported part and having a mound-shaped surface convexly curved upward or downward; and a follower provided at the other of the support part and the supported part and configured to allow a relative movement to the mound-shaped surface while contacting the mound-shaped surface, and the wavy plate is associated with the follower such that a movement end inclines downward when the seat moves from a neutral position in accordance with the relative movement between the mound-shaped surface and the follower.

2. The chair according to claim 1, comprising, in addition to the support mechanism, a second support mechanism configured to move the seat in a direction intersecting with a relative movement direction between the mound-shaped surface and the follower.

3. The chair according to claim 2, wherein the support mechanism is configured to shift the center of gravity of the seat upward in accordance with the movement of the seat from the neutral position when no one is seated.

4. The chair according to claim 1, wherein the mound-shaped surface is provided to extend in a direction intersecting with a relative movement direction to the follower so as to straddle a center line in one of a front-back direction and a right-left direction of the seat, and the followers are arranged to make contact with the mound-shaped surface at opposite sides of the center line.

5. The chair according to claim 1, wherein the mound-shaped surface is provided to extend in a direction intersecting with a relative movement direction to the follower so as to straddle a center line in one of a front-back direction and a right-left direction of the seat, and the follower extends from one end to the other end in a direction orthogonal to a guide direction of the mound-shaped surface and has a shape to be contactable with the mound-shaped surface from the one end to the other end.

6. The chair according to claim 1, wherein the seat is supported independently movably in each of the front-back direction and the right-left direction, and the support mechanism configured to support movement in at least one of the front-back direction and the right-left direction includes the wavy plate and the follower.

7. The chair according to claim 6, wherein the support mechanism is configured to shift the center of gravity of the seat upward in accordance with the movement of the seat from the neutral position when no one is seated.

8. The chair according to claim 1, wherein the support mechanism is configured to shift the center of gravity of the seat upward in accordance with the movement of the seat from the neutral position when no one is seated.

9. The chair according to claim 1, comprising an anti-removal element configured to make contact with the back side of a contact surface with which the follower makes contact with respect to the mound-shaped surface on the wavy plate and to prevent separation between the mound-shaped surface and the follower.

10. The chair according to claim 9, wherein the anti-removal element is an at removal follower contactable with the back side of the contact surface.

11. The chair according to claim 9, wherein the anti-removal element is swingably supported through a link from the follower.

12. The chair according to claim 1, wherein the anti-removal element is swingable supported through a link from the follower.

* * * * *